United States Patent [19]

Reynolds

[11] Patent Number: 4,881,293

[45] Date of Patent: Nov. 21, 1989

[54] WEDGE MEMBER FOR USE ON CARPETED FLOORS

[76] Inventor: Francis A. Reynolds, 300 Edgeley Road, Cheadle Heath, Stockport, Cheshire, England

[21] Appl. No.: 222,049

[22] Filed: Jul. 21, 1988

[51] Int. Cl.[4] ..... E05C 17/54

[52] U.S. Cl. ..... 16/86 A; 292/343; D8/402

[58] Field of Search ..... 16/82, 8 GR, 8 GA; D8/402; 292/342, 343, DIG. 15

[56] References Cited

U.S. PATENT DOCUMENTS

| | | | |
|---|---|---|---|
| 171,807 | 1/1876 | Hoffman | 292/343 |
| 377,927 | 2/1888 | Campbell | 292/343 |
| 804,585 | 11/1905 | Depue | 292/343 |
| 1,845,829 | 2/1932 | Carnal | 292/343 |
| 1,915,795 | 6/1933 | MacMillan . | |
| 1,939,402 | 12/1933 | Mosher | 16/86 A |
| 2,898,140 | 8/1959 | Gislason . | |
| 3,143,369 | 8/1964 | Adams . | |
| 3,328,065 | 6/1967 | Arenson | 292/343 |
| 3,706,112 | 12/1972 | Newell | 16/82 |
| 4,230,353 | 10/1980 | Bjorgum | 292/343 |

*Primary Examiner*—Fred A. Silverberg
*Attorney, Agent, or Firm*—John E. McRae

[57] ABSTRACT

A wedge member usable as a door stop on a carpeted floor. Special triangular cross-sectioned grooves are formed in the lower face of the wedge member to bend and trap carpet pile yarns, whereby the wedge member is prevented from sliding out from beneath the door lower edge.

1 Claim, 1 Drawing Sheet

WEDGE MEMBER FOR USE ON CARPETED FLOORS

BACKGROUND OF THE INVENTION

This invention relates to door stops of the wedge member type. Prior to my invention others have proposed door stop constructions of one type or another. U.S. Pat. No. 1,915,795 to S. MacMillian shows a door stop 5 pivotally attached to the lower portion of a door 4; the floor-engagement surface 20 of the door stop is formed of a resilient material having a knurled surface contour.

U.S. Pat. No. 2,898,140 to W. Gislason shows a door stop that includes a wedge member 18 having gripper type serrations on its lower face.

U.S. Pat. No. 3,143,369 to F. Adams discloses a door stop in the form of a circular pad 3; a rotary screw member 1 extends through the pad to engage the floor surface. Member 1 can be turned to raise pad 3 into a wedged position relative to the door.

SUMMARY OF THE INVENTION

My invention relates to a wedge member especially designed for use on a carpeted floor to retain a door in open or closed position. The undersurface of the wedge member has a number of wide grooves therein designed to cause the pile yarns in the carpet to bend over and become trapped in the grooves, thereby preventing the wedge member from inadvertantly sliding on the carpet surface.

The wedge member has the following general advantages:

1. One piece design for low cost manufacturing,
2. Small size for economical packaging and transport,
3. Usability on a wide variety of floor surfaces, e.g. carpeting, wood flooring, etc.
4. Complete portability for use wherever deemed necessary or desirable.

THE DRAWINGS

DESCRIPTION OF A PREFERRED EMBODIMENT OF THE INVENTION

Figure 2:
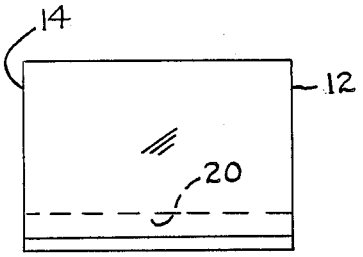
FIG. 2 is an left end elevational view of the FIG. 1 wedge member.
Figure 1:
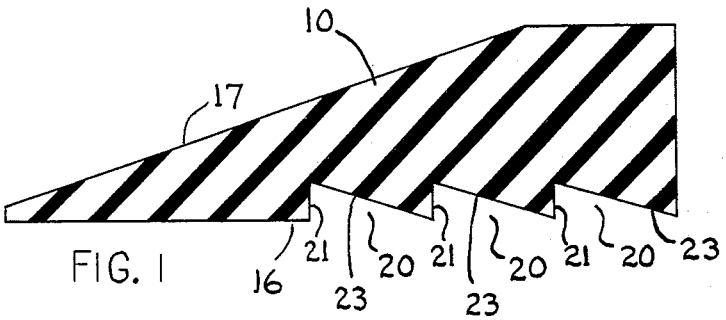
FIG. 1 is a sectional view taken through a wedge member embodying my invention.

FIG. 1 shows one form that my invention can take. A three dimensional wedge member 10 is formed with two vertical side faces 12 and 14, a lower face 16, and an inclined upper face 17. Lower face 16 has three transverse triangular grooves 20 extending the full width dimension of the wedge member, i.e. from side face 12 to side face 14.

Each groove 20 is defined by a vertical upstanding side surface 21 and an inclined roof surface 23. Each roof surface 23 is inclined in a direction opposite to the direction of incline of wedge member face 17. For example, as seen in FIG. 1, each roof surface 23 is inclined in a right-to-left direction, whereas face 17 is inclined in a left-to-right direction.

The length of each roof surface 23 (in FIG. 1) is preferably about three times the vertical height of the associated side surface 21. Each side surface 21 has a height of at least one eighth inch. Roof surfaces 23 have inclination angles on the order of seventeen degrees.

Figure 3:
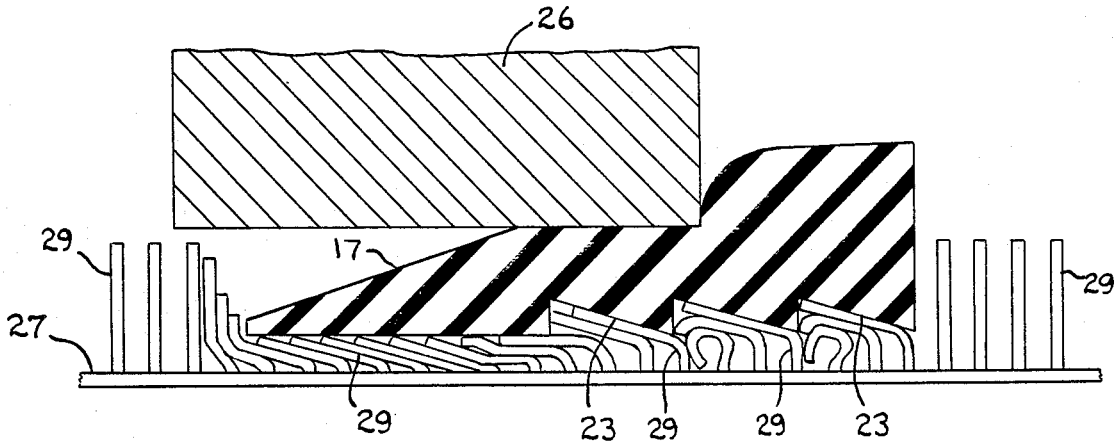
FIG. 3 is a view taken in the same direction as FIG. 1, but illustrating the member in use on a carpeted floor.

Wedge member 10 is formed of an elastomeric material having a durometer that is sufficient to preclude excessive longitudinal bending when member 10 is positioned between the lower edge of a door 26 and carpeting 27 (FIG. 3). As will be seen from FIG. 3, the wedge member is sufficiently soft that its upper face 17 is slightly deformed by contact with the door lower edge. The door exerts a downward force on the wedge member, which causes the groove roof surfaces 23 to bend the carpet pile yarns 29 toward the associated groove vertical side surfaces 21.

The bent-over carpet pile yarns 29 are trapped within grooves 20, with their length dimensions generally facing the groove side surfaces 21. This arrangement effectively prevents slide-out of the wedge member from the FIG. 3 operative position. A roof 23 inclination angle of about seventeen degrees is a preferred angle for producing the desired bending of the pile yarns toward groove surface 21.

Each groove 20 preferably has a vertical depth of at least about one eighth inch in order to produce a sufficiently sized groove for accommodating a plural number of pile yarns. Each pile yarn has a substantial percentage of its length trapped within the groove, as shown in FIG. 3.

Preferably wedge member 10 is constructed as a relatively small size structure, for low cost manufacturing and economical packaging. For example, the wedge member can have a length on the order of two and one half inches, and a side-to-side width of about one inch. With such small dimensions the thinnest vertical section of member 10 (the leftmost section in FIG. 1) is not very thick in an absolute sense. Therefore, to preserve the integrity of member 10 the leftmost section of the wedge member lower face 16 is devoid of grooves; the leftmost section of face 16 has a flat planar contour.

The three grooves 20 take up slightly more than one half the length of the wedge member lower face 16. For best results it is believed that three relatively wide grooves should be used; the grooves should be located in the thickest vertical section of the wedge member to give the member sufficient rigidity during use.

The drawings show one form that the invention can take. Other forms are possible.

I claim:

1. A three dimensional wedge member designed to rest on a carpet to engage the lower edge of a door for retaining said door against movement:

said wedge member being formed of a resilient elastomeric material;

said wedge member having two upstanding side faces, a lower face, and an inclined longitudinally extending upper face;

said lower face having only three similarly configured transverse grooves, said three transverse grooves occupying slightly more than half of the length of the wedge member lower face in the thickest vertical section of the wedge member, said three grooves having a triangular cross-section and extending transverse to the side faces for the full width dimension of the wedge member;

each triangular groove being defined by a vertical upstanding side surface and an inclined roof surface; each said roof surface being inclined in a direction opposite to the direction of the incline of the wedge member upper face, each said roof surface being inclined at an angle of about seventeen degrees measured from the plane of the wedge member lower face;

the length of each said roof surface being about three times the height of each said groove side surface; each said groove side surface having a height of a least one eighth inch;

whereby each said groove is of sufficient volume and configuration as to cause pile yarns in the carpet to be bent by the groove roof surface toward the associated vertical side surface when the door exerts a downward force on the wedge member upper face.

* * * * *